US011014735B2

(12) United States Patent
Cooper

(10) Patent No.: US 11,014,735 B2
(45) Date of Patent: May 25, 2021

(54) METHOD AND APPARATUS FOR PACKAGING WIRE IN A STORAGE CONTAINER

(71) Applicant: Lincoln Global, Inc., Santa Fe Springs, CA (US)

(72) Inventor: William D. Cooper, Chardon, OH (US)

(73) Assignee: LINCOLN GLOBAL, INC., Santa Fe Springs, CA (US)

( * ) Notice: Subject to any disclaimer, the term of this patent is extended or adjusted under 35 U.S.C. 154(b) by 97 days.

(21) Appl. No.: 16/364,690

(22) Filed: Mar. 26, 2019

(65) Prior Publication Data

US 2020/0307899 A1 Oct. 1, 2020

(51) Int. Cl.

| | |
|---|---|
| ***B65D 85/04*** | (2006.01) |
| ***B21C 47/02*** | (2006.01) |
| ***B65D 25/14*** | (2006.01) |
| ***B65H 54/80*** | (2006.01) |

(52) U.S. Cl.

CPC ..... *B65D 85/04* (2013.01); *B21C 47/02* (2013.01); *B65D 25/14* (2013.01); *B65H 54/80* (2013.01); *B65H 2701/36* (2013.01)

(58) Field of Classification Search

CPC ..... B65D 25/14; B65D 85/04; B65D 85/67; B65H 49/08; B65H 49/10; B65H 49/12; B65H 54/80; B65H 2701/36; B21C 47/02

USPC ..... 206/389, 395, 397, 408, 409; 242/128, 242/129, 170–172, 423.1, 588.3

See application file for complete search history.

(56) References Cited

U.S. PATENT DOCUMENTS

| | | | | |
|---|---|---|---|---|
| 2,542,806 | A | 2/1951 | Ford et al. | |
| 2,895,210 | A | 7/1959 | Hubbard | |
| 6,260,781 | B1 | 7/2001 | Cooper | |
| 6,648,141 | B2 * | 11/2003 | Land | B65H 49/08 206/408 |
| 6,857,521 | B2 | 2/2005 | Cantu-Gonzalez | |
| 7,004,419 | B2 | 2/2006 | Hsu | |
| 8,752,782 | B2 * | 6/2014 | Matthews, III | B65H 49/12 242/423.1 |
| 8,967,520 | B2 * | 3/2015 | Matthews, III | B65H 49/12 242/423.1 |
| 9,193,558 | B2 * | 11/2015 | Matthews | B65H 49/10 |
| 2006/0266794 | A1 | 11/2006 | Melfi et al. | |

FOREIGN PATENT DOCUMENTS

| | | |
|---|---|---|
| CN | 105752744 A | 7/2016 |
| DE | 699 10 357 T2 | 4/2004 |
| DE | 102 02 476 B4 | 9/2005 |

(Continued)

OTHER PUBLICATIONS

Partial European Search Report from Corresponding Application No. 20163338.5; dated Jul. 17, 2020; pp. 1-12.

(Continued)

*Primary Examiner* — Bryon P Gehman

(74) *Attorney, Agent, or Firm* — Brad C. Spencer

(57) ABSTRACT

A container includes an outer box, and a polygonal liner located within the outer box. The polygonal liner has a plurality of vertical walls. A continuous length of wire is located within the polygonal liner and forms a plurality of layers. Each of the layers is comprised of a series of wire loops arrayed polygonally along the vertical walls of the polygonal liner.

13 Claims, 4 Drawing Sheets

(56) References Cited

FOREIGN PATENT DOCUMENTS

| | | | |
|---|---|---|---|
| DE | 602 02 325 | T2 | 12/2005 |
| EP | 1 295 813 | A2 | 3/2003 |
| EP | 1 493 505 | A1 | 1/2005 |
| JP | H07-89514 | A | 4/1995 |
| WO | 2005/095014 | A1 | 10/2005 |

OTHER PUBLICATIONS

Kieselstein; "Horizontal Spooling Machine SH-T"; https://www.kieselstein.com/en/Machines-Plants/Coiler-and-spooling-machinery/Spooling-machinery/Spooling-Machine-SH/T_1549.html; Accessed Aug. 21, 2018; pp. 1-3.

Cam Innovation; "Edgewinding Coils"; https://www.caminnovation.com/coil-manufacturing-equipment/edgewinder; Accessed Aug. 21, 2018; pp. 1-2.

* cited by examiner

METHOD AND APPARATUS FOR PACKAGING WIRE IN A STORAGE CONTAINER

BACKGROUND OF THE INVENTION

Field of the Invention

The present invention relates to packaging wire, such as welding wire, into a bulk storage container. Example bulk storage containers include drums, boxes and the like.

Description of Related Art

It is known to package a continuous length of welding wire in a large container. The wire is formed into a series of loops that are arranged in a circular pattern within the container to form layers of wire. Layer upon layer are added until the container is full, which can require several hundred pounds of wire. The layers of wire, each formed by a series of loops, have a cylindrical shape within the container. If the container is also cylindrical, then each individual loop and layer of wire can be laid close to the container walls. Some containers are square-shaped and have an octagonal liner. In such cases, the layers of wire, which together form a cylindrical shape, do not sit as closely to the inner walls of the container as compared to a cylindrical container. The gaps between the octagonal liner and the wire loops can lead to shifting or settling of the wire within the container during shipment. Wire settling is generally undesirable as it requires the container to be taller than necessary (due to an initial lower density packing of the wire), and can result in tangling of the wire as it is payed out from the container, such as during an automatic or semi-automatic welding operation.

BRIEF SUMMARY OF THE INVENTION

The following summary presents a simplified summary in order to provide a basic understanding of some aspects of the devices, systems and/or methods discussed herein. This summary is not an extensive overview of the devices, systems and/or methods discussed herein. It is not intended to identify critical elements or to delineate the scope of such devices, systems and/or methods. Its sole purpose is to present some concepts in a simplified form as a prelude to the more detailed description that is presented later.

In accordance with one aspect of the present invention, provided is a container. The container includes an outer box, and a polygonal liner located within the outer box. The polygonal liner has a plurality of vertical walls. A continuous length of wire is located within the polygonal liner and forms a plurality of layers. Each of the layers is comprised of a series of wire loops arrayed polygonally along the vertical walls of the polygonal liner.

In accordance with another aspect of the present invention, provided is a container. The container includes a rectangular box, and at least one polygonal liner located within the rectangular box and forming a plurality of vertical walls arranged in a polygonal shape. A continuous length of wire is located within the box and forms a plurality of layers. Each of the layers is comprised of a series of wire loops arrayed polygonally along the vertical walls.

In accordance with another aspect of the present invention, provided is a wire coiling apparatus. The wire coiling apparatus includes a rotatable wire laying head for forming a series of wire loops from a continuous length of wire. An X-Y table is configured to move in linear X-Y directions beneath the rotatable wire laying head while the series of wire loops are being formed such that the series of wire loops are arrayed polygonally within a storage container supported by the X-Y table due to the linear X-Y movement of the X-Y table.

In accordance with another aspect of the present invention, provided is a method of packaging a wire coil. The method includes providing a coiling machine. The coiling machine includes a rotatable wire laying head for forming a series of wire loops from a continuous length of wire. The coiling machine also includes an X-Y positioner configured to move in linear X-Y directions while the series of wire loops are being formed. A storage box having polygonal interior walls is placed onto the coiling machine. The series of wire loops are formed within the storage box while simultaneously moving the storage box in the linear X-Y directions by the X-Y positioner such that the series of wire loops are arrayed polygonally inside of the polygonal interior walls of the storage box.

BRIEF DESCRIPTION OF THE DRAWINGS

The foregoing and other aspects of the invention will become apparent to those skilled in the art to which the invention relates upon reading the following description with reference to the accompanying drawings, in which.

DETAILED DESCRIPTION OF THE INVENTION

Figure 1:
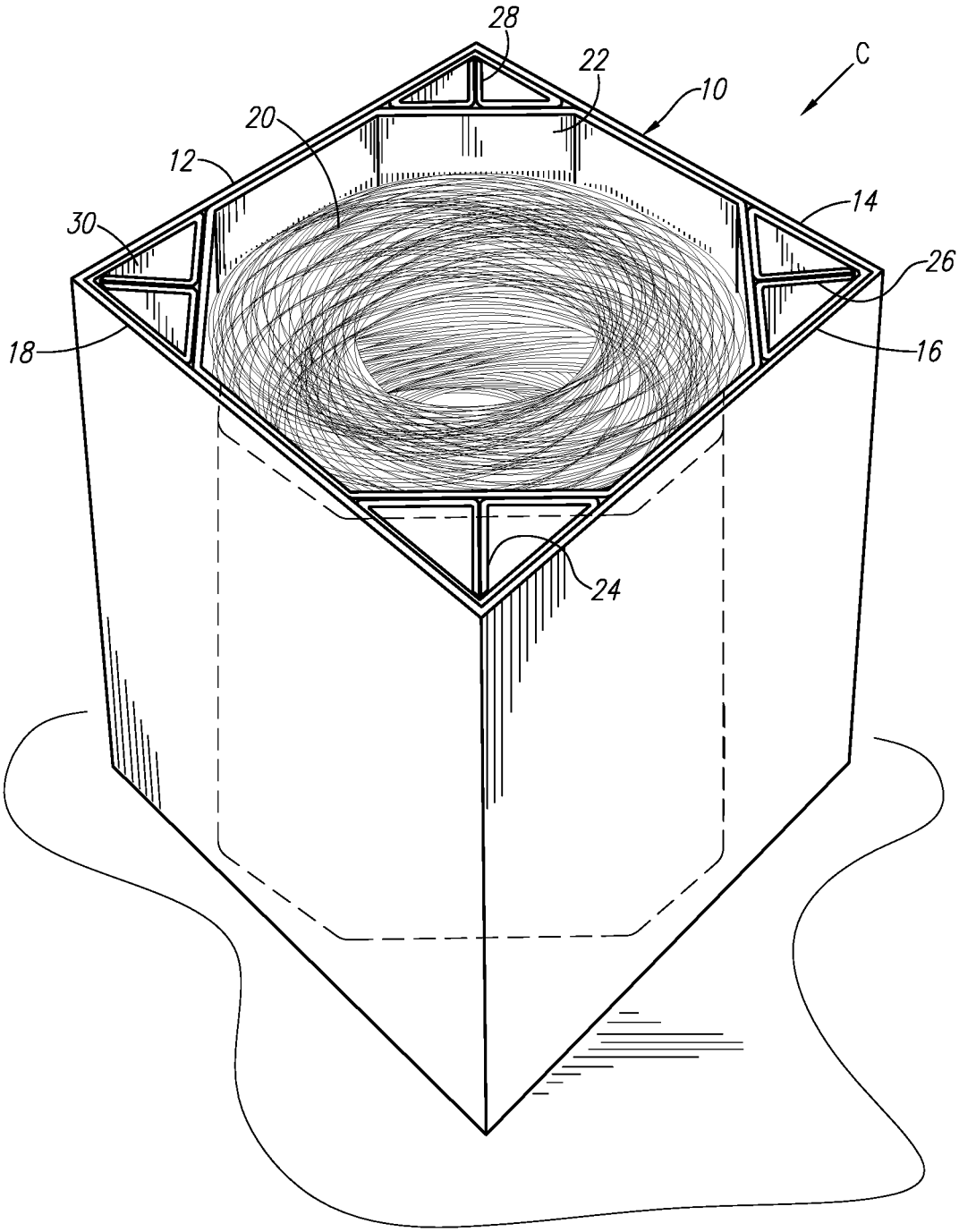
FIG. 1 is a perspective view of a container of wire.

The present invention relates to the bulk packaging of wire, such as welding wire. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention can be practiced without these specific details. Additionally, other embodiments of the invention are possible and the invention is capable of being practiced and carried out in ways other than as described. The terminology and phraseology used in describing the invention is employed for the purpose of promoting an understanding of the invention and should not be taken as limiting.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. Any disjunctive word or phrase presenting two or more alternative terms, whether in the description of embodiments, claims, or drawings, should be understood to contemplate the possibilities of including one of the terms, either of the terms, or both terms. For example, the phrase "A or B" should be understood to include the possibilities of "A" or "B" or "A and B."

FIG. 1 shows a storage container C in the form of a rectangular box, in particular a square-shaped box 10. The box can be formed from cardboard or a material having similar structural characteristics. The box 10 has outer side walls 12, 14, 16 and 18 that define four corners. To support a coil 20 of wire within the box 10, a polygonal liner, such as an octagonal liner 22 is located within the outer box 10. The liner 22 can also be made from cardboard or a similar material. The liner 22 has a plurality of vertically-extending walls that are either placed against the inner walls of the box 10 or extend diagonally across the inner corners of the box. The diagonal walls of the liner 22 at the corners of the box 10 form triangular corner cavities that can be filled with reinforcing elements 24, 26, 28, 30. Rather than including a single liner, the storage container C could include multiple liner members (e.g., triangular corner inserts) that together with the walls of the box form the polygonal shape of the interior of the storage container.

The coil 20 of wire has a generally polygonal (e.g., octagonal) cross-sectional shape, to match the shape of the liner 22. Conventional wire containers that utilize an octagonal liner hold a coil of wire that is cylindrically-shaped. The difference in shapes between the cylindrical coil and octagonal liner results in gaps between the coil and the walls of the liner, and can lead to wire settling during shipment. When the wire settles, the likelihood that it will tangle when payed out from the container increases. The octagonal coil 20 in FIG. 1 has fewer gaps between the coil and the walls of the liner 22, as compared to a conventional cylindrical coil. Thus, the octagonal coil 20 is less likely to experience settling within the container C, or settle to a lesser degree, than a conventional cylindrical coil.

As will be explained below, the coil 20 is formed by a continuous length of wire arranged in a plurality of layers. Each of the layers is comprised of a series of circular loops of wire. The diameter of each loop is slightly smaller than the wall-to-wall width of the liner 22 (e.g., approximately 15% less than the wall-to-wall width of the liner). The center of each loop is radially offset from the axis of the box 10 and liner 22, towards the walls of the liner. The series of wire loops that form the layers of wire are arrayed polygonally (e.g., in a rectangle, octagon, dodecagon, etc.) along the vertical walls of the liner 22, to match the shape of the liner. The polygonal array of wire loops has straight sections along the center portions of the liner walls, and curved or radiused vertices. As the layers of wire formed by each series of polygonally-arrayed loops are built up, layer upon layer, the coil of wire assumes the shape of a polygonal (e.g., octagonal) prism having a central opening and radiused vertices. The loops of wire are laid in a polygonal array by moving the storage container C and/or a rotating wire laying head in linear X-Y directions while the loops are formed by the laying head of a wire coiling apparatus.

Figure 2:
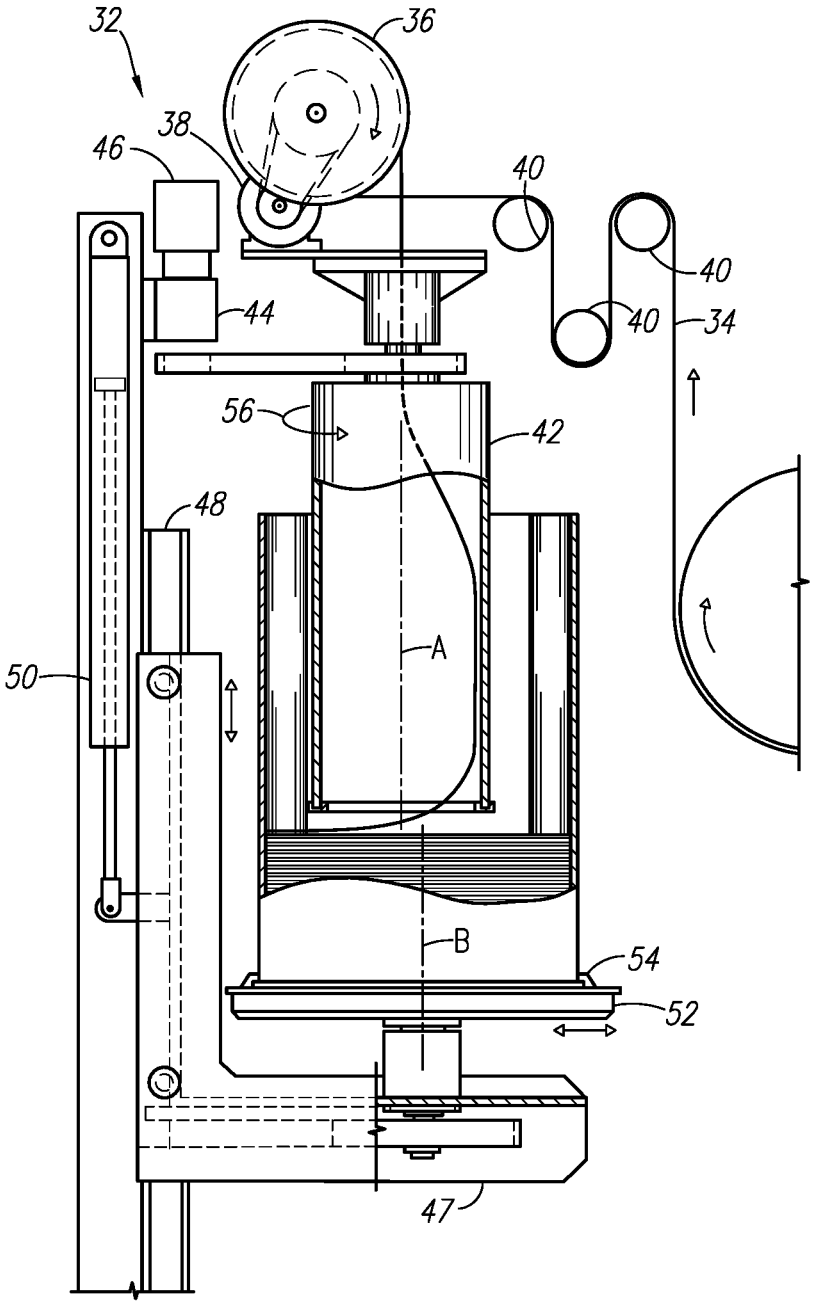
FIG. 2 shows portions of a wire coiling apparatus.

FIG. 2 shows portions of an example wire coiling apparatus 32. A continuous length of welding wire 34 is drawn from a manufacturing process (not shown). The welding wire 34 is drawn by a capstan 36 driven by a motor 38. A series of dancer rollers 40 maintain tension on the wire. The welding wire 34 is wrapped approximately 270° about the capstan 36. This provides proper friction and drive capacity to draw the welding wire 34 across the dancer rollers 40.

From the capstan 34, the welding wire is fed into a rotatable wire laying head 42. The laying head 42 can be a generally cylindrical tube having an opening at the bottom or along the cylinder adjacent to the bottom. The welding wire 34 passes from the capstan 36 to the interior of the laying head 42. The welding wire 34 extends through the tube and out the opening in the laying head 42, whereupon it is placed into the storage container C. The laying head 42 is suspended from an upper portion of the coiling apparatus 32 for rotation about a generally vertical axis A.

The laying head 42 extends into the storage container C and rotates about the axis A, which is generally parallel to an axis B of the storage container. The wire being fed into the laying head 42 by the capstan 34 is fed at a rotational velocity different than the rotational velocity of the laying head. The ratio between the rotational velocity of the laying head 42 and the rotational velocity of the capstan 34 determines the loop size diameter of the wire loops within the storage container C. A motor 44 drives the laying head 42, such as via a drive belt. A controller 46 controls the speed of the capstan and laying head motors 38, 44 and allows for adjustments of the ratio between the speed of the two motors, to thereby adjust the diameter of the wire loops that form the polygonal coil. Example wire loop diameters are approximately 14-17 inches, however diameters outside of this range can be provided if desired.

As the wire 34 is laid within the storage container C, sensors check the wire height and the storage container is lowered by the controller 46. As the storage container moves downward, the laying head 42 continues to rotate, thus filling storage container C to its capacity. The storage container C is supported on an L-shaped beam 47 that is vertically-movable along a guide track 48 (e.g., in the Z-direction shown by double headed arrow). A cylinder and piston assembly 50 and/or an actuator such as a ball screw actuator is attached to the L-shaped beam and a frame of the coiling apparatus 32 and allows for the controlled descent of the storage container C as it is filled with wire. It is to be appreciated that laying head 42 need not move in the vertical direction because the storage container C moves downward, away from the laying head, as it is filled.

The coiling apparatus 32 includes an X-Y table 52 or a similar X-Y positioner, to which the storage container C is mounted. The X-Y table 52 can include clips 54 or other clamping devices for attaching the storage container C securely to the X-Y table. The X-Y table 52 moves the storage container C in the X and Y directions (e.g., within a generally horizontal plane) beneath the laying head 42 while the series of wire loops are being formed. The Y-direction is shown schematically by a horizontal double headed arrow in FIG. 2, and the X-direction would be perpendicular to the Y-direction and the Z-direction (e.g., into and out of the plane of the figure). The X-Y table 52 or positioner can employ linear actuators, such as belt-driven actuators, ball or lead screw actuators, rack-and-pinion actuators, pneumatic or hydraulic actuators, and the like. The movement of the X-Y table 52 during operation of the laying head 42 is controlled so that the series of wire loops that form layers of the coil 20 are arrayed polygonally within the storage container C, along the polygonal walls of the liner. In particular, the loops are arrayed in an octagonal pattern established by the X-Y table 52 moving the container C beneath the laying head 42. The movement of the X-Y table 52 can be controlled by the controller 46. Alternatively, the laying head 42 can be moved in X-Y directions while forming the wire loops. If desired, the X-Y table 52 can provide for variable speed movements in the X and Y directions, to allow the wire loops to be arrayed along curved lines. In certain embodiments, the wire coiling apparatus 32 can include a turntable that allows the container C to be rotated around its axis B, in addition to moving in the X and Y directions. The turntable can allow for the series of loops to be laid in a circular pattern if desired.

The controller 46 can include an electronic controller having one or more processors. For example, the controller 46 can include one or more of a microprocessor, a microcontroller, a digital signal processor (DSP), an application specific integrated circuit (ASIC), a field-programmable gate array (FPGA), discrete logic circuitry, or the like. The controller 46 can further include memory and may store program instructions that cause the controller to provide the functionality ascribed to it herein. The memory may include one or more volatile, non-volatile, magnetic, optical, or electrical media, such as read-only memory (ROM), random access memory (RAM), electrically-erasable programmable ROM (EEPROM), flash memory, or the like. The controller 46 can further include one or more analog-to-digital (A/D) converters for processing various analog inputs to the controller.

Figure 3:
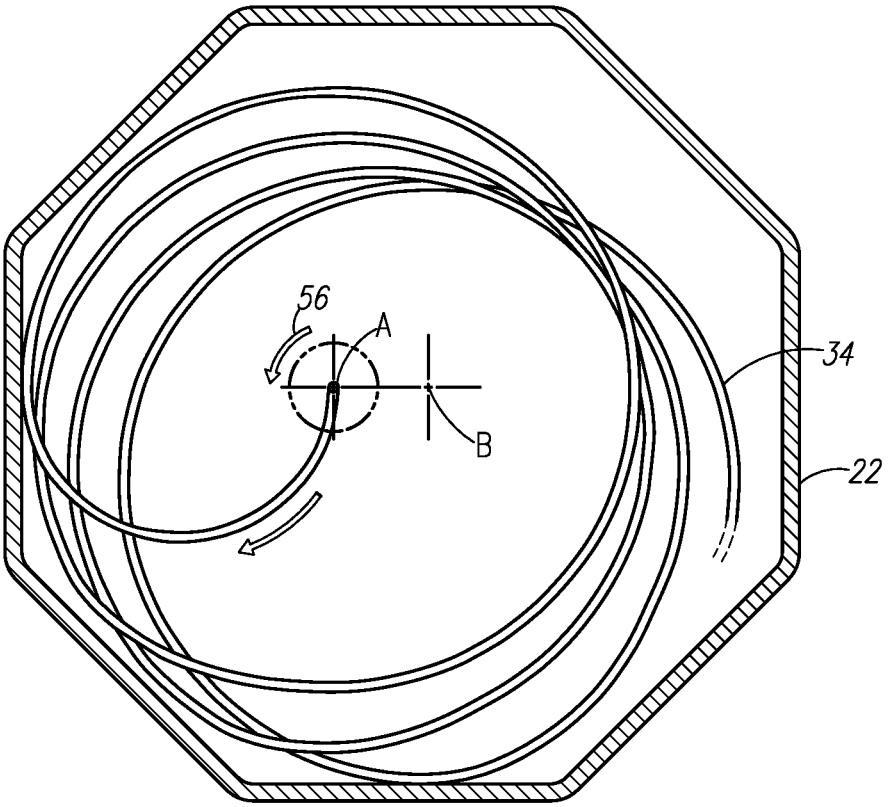
FIG. 3 shows the placement of wire loops within a polygonal liner.
Figure 4:
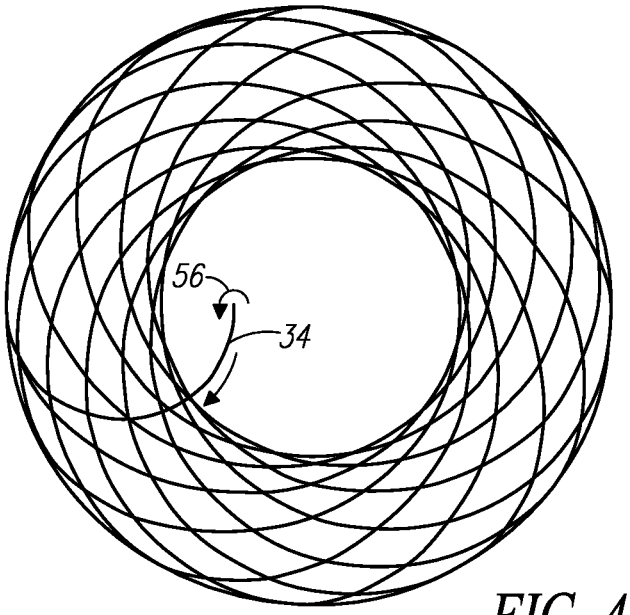
FIG. 4 shows a circular layer of wire loops.

FIG. 3 shows the result of placing wire loops in a circular array within an octagonal liner 22, and FIG. 4 schematically shows an example circular array of the wire loops. The welding wire 34 is looped within the liner 22 by rotation of the laying head about its axis A. The rotation of the laying head is shown by arrow 56. The axis A of the laying head is radially offset from the axis B of the storage container and liner 22. The storage container is rotated counterclockwise a fraction of one revolution (e.g., one or two degrees) while the laying head generates the wire loops. Rotating the storage container while generating the wire loops results in the creation of the circular array of loops. It can be seen in FIG. 3 that some of the loops in the circular array touch the sides of the liner 22, whereas other do not. Gaps exist between the loops and liner wall in the lower left portion of FIG. 3. It is such gaps that allow the wire to settle during shipment of the container of wire, which can result in tangling of the wire as it is payed out of the container and need for a taller container.

Figure 5:
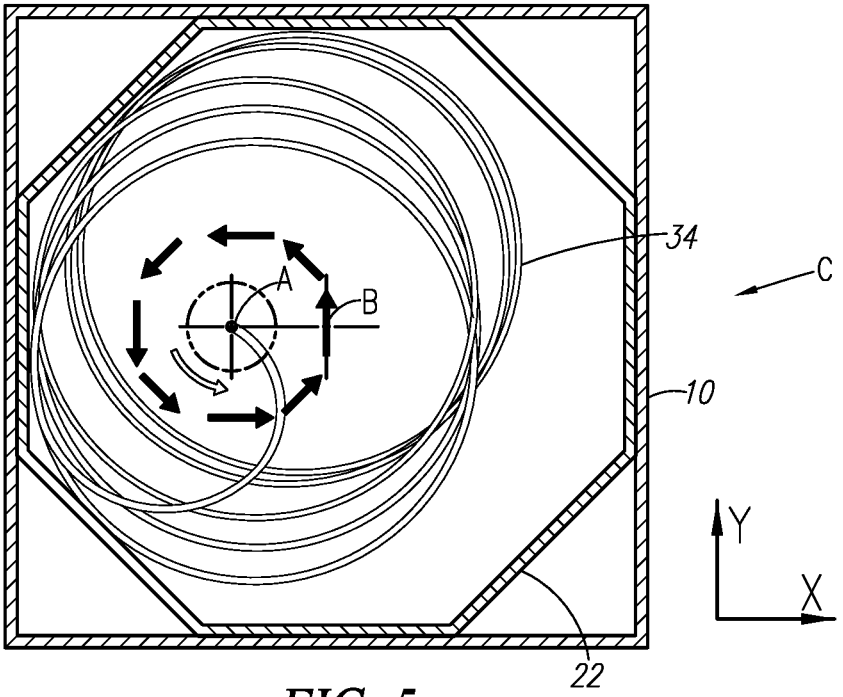
FIG. 5 schematically shows movements of a container during filling.
Figure 6:
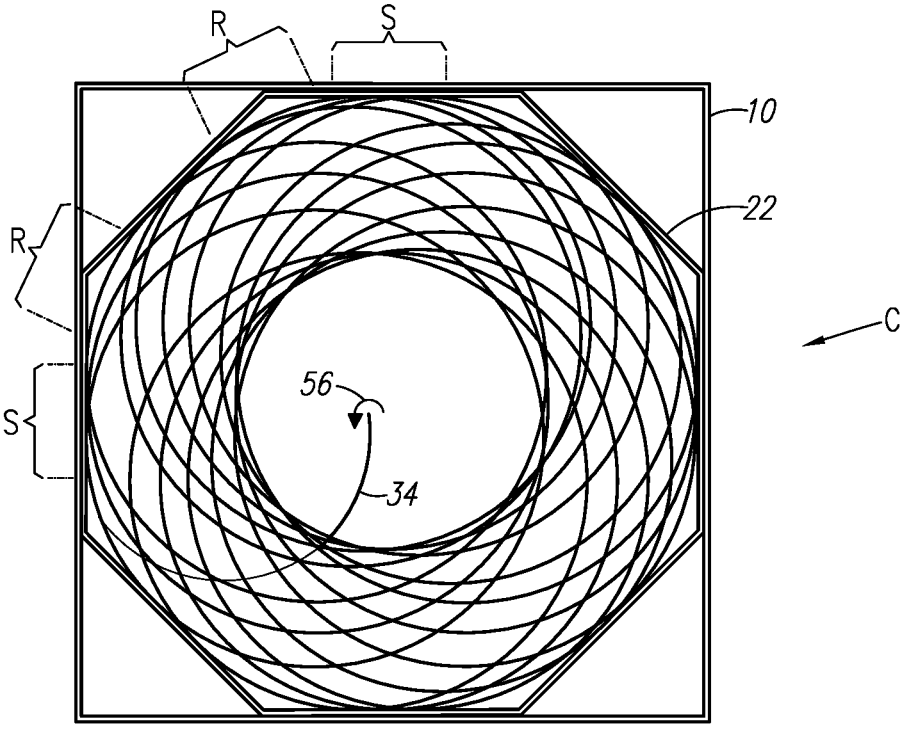
FIG. 6 shows a polygonal layer of wire loops.

FIG. 5 shows example linear movements of the storage container C in the X and Y directions beneath the wire laying head while the series of wire loops are formed. FIG. 6 shows an example polygonal array of the wire loops, such as would be found in a layer of loops in the container C. The axis B of the storage container C can be offset from the rotational axis A of the laying head so that the loops of wire in the polygonal array are not centered in the storage container, but are offset toward the vertical walls of the octagonal liner 22. The amount of offset between the axis B of the storage container C and the rotational axis A of the laying head can depend on the diameter of the wire loops, and, thus, the rotational velocities of the capstan and laying head. Smaller wire loops are formed using a greater offset between the axis B of the storage container C and the rotational axis A of the laying head, so that the loops are placed along the walls of the liner 22. When larger wire loops are formed, the offset between the axis B of the storage container C and the rotational axis A of the laying head is reduced. The offset between axes A and B can be controlled by the controller 46 (FIG. 2), based on the desired loop diameter. To minimize the gaps between the loops of wire and the inner walls of the liner 22, the loops can be placed within the liner so that they each touch at least one of the walls of the octagonal liner 22 at a tangent. This can be achieved by properly offsetting the axis B of the storage container C from the rotational axis A of the laying head, and moving the storage container in linear X-Y directions while forming the loops of wire. As the storage container C is moved while the wire loops are formed, the offset between the axis B of the storage container C and the rotational axis A of the laying head will change, for example increase and decrease, as the container is moved in an octagonal pattern as indicated by the arrows in FIG. 5. An example offset between the axis B of the storage container C and the rotational axis A of the laying head is one-half the difference between the interior width of the liner 22 (wall-to-wall distance between opposed vertical walls) and the diameter of the wire loop when the axis B of the storage container and the rotational axis A of the laying head are aligned with the centers of the opposed vertical walls of the liner. In certain embodiments, the loop size can be adjusted while the container C is being filled, so that some layers of wire are formed by loops of a first diameter and other layers of wire are formed by loops of a second diameter, different from the first diameter. In such embodiments, the offset between the axis B of the storage container C and the rotational axis A of the laying head can be adjusted and controlled while the storage container is being filled to accommodate the different diameter loops of wire.

As indicated by the arrows in FIG. 5, the storage container C is moved by the X-Y table 52 (FIG. 2) or positioner in an octagonal pattern, so that the wire loops are laid in an octagonal array that matches the shape liner 22. The pattern and direction of the arrows in FIG. 5 is exemplary and the storage container C could be moved in opposite directions (e.g., in a clockwise octagonal pattern) and in other patterns (e.g., a square or other polygonal pattern). To array the wire loops in an octagonal pattern, the X-Y table or positioner moves the storage container C in eight different linear directions in the X-Y plane while the wire loops are formed by rotation of the laying head. The diameter of the wire loops is controlled by the rotational speed of the capstan and laying head, and the placement of the wire loops in the storage container C is controlled the movements of the X-Y table or positioner. Preferably, each wire loop touches at least one of the vertical walls of the liner 22 at a tangent to minimize the gaps between the coil of wire and the walls of the liner. However, some loops may not touch a wall of the liner while other loops (e.g., the majority of the loops) do. As the storage container C is moved in an octagonal pattern, the axis B of the storage container travels around the rotational axis A of the laying head in X-Y directions in the octagonal pattern, so that the wire loops are laid against the vertical walls of the liner 22. In certain embodiments the storage container C can also be rotated by a turntable while the wire loops are formed in the container and such rotation can occur with or without simultaneously moving the storage container in the X and/or Y directions. In other embodiments, the X-Y table or positioner moves the storage container C in the linear X-Y directions beneath the rotatable wire laying head while the series of wire loops are being formed without rotating the storage container about the axis B of the storage container. In certain embodiments, the laying head can be moved in the X and Y directions to lay the wire loops in a desired polygonal pattern. Alternatively, the laying head can be configured for movement in one of the X and Y directions and the wire coiling apparatus can move the storage container C in the other of the X and Y directions, so that the laying head and storage container move together while the wire loops are formed, to array the loops polygonally.

Comparing the circular array of wire loops shown in FIG. 4 and the octagonal array of wire loops shown in FIG. 6, it can be seen that the octagonal array of wire loops has straight sections S along the center portions of the liner 22 walls, and curved or radiused vertices R. The radius of the vertices R is large so that the octagonal shape of the array of wire loops has eight short, straight sides S connected by sweeping curves R of about the same length as the short, straight sides. The relative lengths of the straight sections S and the curved vertices R formed by the polygonal array of wire loops is determined by the interior wall-to-wall width of the liner 22 and the diameter of the wire loops. As the diameter of the loops is made smaller, the length of the straight sections S of the polygonal array increases and the length of the curved vertices R connecting the straight sections decreases. As the diameter of the loops increases, the length of the straight sections S of the polygonal array decreases and the length of the curved vertices R connecting the straight sections increases.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A container, comprising:

an outer box;

a polygonal liner located within the outer box and having a plurality of vertical walls; and a continuous length of wire within the polygonal liner forming a plurality of layers, each of the layers being comprised of a series of wire loops arrayed polygonally along the vertical walls of the polygonal liner, wherein each series of wire loops includes consecutive wire loops that touch a same vertical wall of the polygonal liner at a tangent.

2. The container of claim 1, wherein the series of wire loops are arrayed octagonally.

3. The container of claim 2, wherein the polygonal liner is octagonal.

4. The container of claim 1, wherein each of the wire loops touches at least one of the vertical walls at a tangent.

5. The container of claim 1, wherein the series of wire loops are arrayed in an octagonal pattern having straight sections located along center portions of the vertical walls, and curved sections between the straight sections.

6. A container, comprising:

a rectangular box;

at least one liner located within the rectangular box and forming a plurality of vertical walls arranged in a polygonal shape; and a continuous length of wire within the rectangular box forming a plurality of layers, each of the layers being comprised of a series of wire loops arrayed polygonally along the vertical walls, wherein each series of wire loops includes consecutive wire loops that touch a same vertical wall of the at least one liner at a tangent.

7. The container of claim 6, wherein the series of wire loops are arrayed octagonally.

8. The container of claim 7, wherein the at least one liner has an octagonal shape.

9. The container of claim 8, wherein each of the wire loops touches an inner surface of at least one of the vertical walls.

10. The container of claim 9, wherein the rectangular box is square-shaped.

11. The container of claim 6, wherein the series of wire loops are arrayed in an octagonal pattern having straight sections located along center portions of the vertical walls, and curved sections between the straight sections.

12. A container, comprising:

a square outer box;

an octagonal-shaped liner located within the square outer box; and a continuous length of wire within the octagonal-shaped liner forming a plurality of layers, each of the layers being comprised of a series of wire loops arrayed in an octagonal pattern along walls of the octagonal-shaped liner, wherein each series of wire loops includes consecutive wire loops that touch a same wall of the octagonal-shaped liner at a tangent.

13. The container of claim 12, wherein the octagonal pattern includes straight sections located along center portions of walls of the octagonal-shaped liner, and curved sections between the straight sections.

* * * * *